United States Patent [19]

Ikeda

[11] Patent Number: 4,541,813

[45] Date of Patent: Sep. 17, 1985

[54] DEVICE FOR CONTROLLING WHEELED VEHICLES

[75] Inventor: Masaki Ikeda, Tokyo, Japan

[73] Assignee: Tomy Kogyo Company, Incorporated, Japan

[21] Appl. No.: 515,953

[22] Filed: Jul. 20, 1983

[30] Foreign Application Priority Data

Jul. 21, 1982 [JP] Japan ..... 57-111452

[51] Int. Cl.[4] ..... A63H 29/00

[52] U.S. Cl. ..... 446/429; 446/444

[58] Field of Search ..... 446/429, 435, 441, 444, 446/445, 448, 449, 454, 455

[56] References Cited

U.S. PATENT DOCUMENTS

| | | | |
|---|---|---|---|
| 3,707,805 | 1/1973 | Buck | 446/444 |
| 3,750,328 | 8/1973 | Nielsen et al. | 446/429 |
| 3,798,832 | 3/1974 | Terzian | 446/429 |
| 3,886,682 | 6/1975 | Ieda et al. | 446/429 |
| 3,959,920 | 6/1976 | Ieda | 446/429 |
| 3,986,717 | 10/1976 | Kirby et al. | 446/429 |
| 4,016,674 | 4/1977 | Resnick et al. | 446/429 |
| 4,146,991 | 4/1979 | Sano | 446/444 |
| 4,192,093 | 3/1980 | Hamano | 446/435 |
| 4,363,186 | 12/1982 | Goldfarb et al. | 446/429 |
| 4,433,504 | 2/1984 | Terui | 446/429 |

*Primary Examiner*—Robert A. Hafer
*Assistant Examiner*—Daniel Nolan
*Attorney, Agent, or Firm*—K. H. Boswell

[57] ABSTRACT

A launching device for wheeled toy vehicles has a housing with a vehicle support surface located on the housing. An opening is located in the support surface so as to allow one of the wheels of the vehicle to be partially located within the opening. An element in the housing is movable toward and away from the opening and when moved toward the opening with the wheel of the vehicle located in the opening the element contacts the wheel to lift the wheel out of the opening so as to launch the vehicle from the housing. A release lever is connected to the element so as to lift the element toward the opening when it is desirable to release the vehicle from the housing.

16 Claims, 9 Drawing Figures

20
22
24
26
30
32
34
36
38
40
42
44
46
48
50
52
54
56
58
60
62
68
70
72
74
86
104
106
108

DEVICE FOR CONTROLLING WHEELED VEHICLES

BACKGROUND OF THE INVENTION

This invention is directed to a device for releasing wheeled toy vehicles onto a track or support surface. Further, the device is capable of energizing these vehicles such that the vehicles move across the track or support surface.

A class of wheeled vehicles known under the trade name POP CYCLES TM and distributed by the assignee of this invention have found wide acceptance in the marketplace. One design for these vehicles is that of a motorcycle. This POP CYCLE TM has typical front and back wheels which are rotatably mounted to the motorcycle body. A rider is positionable on the toy in several positions, however, the rider need not be part of the toy for the toy to function. The front wheel is of a common design and typically is formed of a plastic material as is the body and rider portion of the toy. The rear wheel differs from the front wheel in that it serves as a flywheel and thus is preferredly formed of a material of a sufficient mass, such as a metal or the like.

For normal operation of the above described POP CYCLE TM, an elongated flexible element having a gear rack along one edge is inserted between a pinion fixedly attached to the rear wheel and a guide formed on the body of the motorcycle. After insertion the element is pulled in the opposite direction such that the rack on the elongated flexible element engages the pinion and spins the pinion and the rear wheel. This causes the rear wheel to spin rapidly and since it has sufficient mass, its spinning is maintained by the flywheel effect of the mass. The POP CYCLE TM can then be set on a support surface or a track and propelled by the kinetic energy of the flywheel type rear wheel.

When a single child has several of these toys, or when two or more children each have one, a contest as to who has the "hottest" POP CYCLE TM naturally ensues. If a single child is matching two or more of his POP CYCLES TM against one another, he can only activate one at a time, and as such, as he sequentially activates them, some of the kinetic energy stored in the flywheels of the earlier activated units is dissipated prior to placement of all of the units simultaneously on a support surface or track. Inevitably, the last unit to be so activated therefore wins the race.

If two or more children are competing their POP CYCLES TM against one another, the amount of kinetic energy which one child can supply to his POP CYCLE TM compared to another sometimes varies because of manual dexterity, strength and the like of the children. Thus, a race between two such POP CYCLES TM sometimes does not reflect which of the POP CYCLES TM was "the hottest", but simply reflects the dexterity or strength of the child operating the same.

BRIEF DESCRIPTION OF THE INVENTION

In view of the above, it is an object of this invention to provide a device which is capable of controlling the operation of one or more wheeled toy vehicles. It is a further object of this invention to provide a device which is capable of controlling the time of release of the wheeled vehicle from the device, as well as, in the preferred embodiment, supplying energy to the vehicle so as to energize the vehicle. Additionally, it is an object of this invention to provide such a device which, because of its engineering and manufacturing principles is economically produced, yet is of durable construction so as to provide many hours of play value.

These and other objects, as will be evident from the remainder of this specification, are achieved in a device for use in association with wheeled toy vehicles which comprises: a support structure; a vehicle support surface located on said support structure, said support surface including an opening, said opening sized and shaped so as to allow one of the wheels of a wheeled toy vehicle to be at least partially located within said opening; an element movably located on said housing in association with said opening, said element movable toward and away from said opening; release means located on said support structure in association with said element, said release means for moving said element toward said opening, said release means moving said element toward said opening such that said element contacts any said wheel located in said opening and displaces said wheel from said opening as said element moves toward said opening.

Preferredly, the device would include a plurality of openings such that a plurality of vehicles could be simultaneously controlled. Each of the openings would include an element associated with it and a release means associated with the element so as to allow for launching of the vehicle from the device by moving the elements towards their respective openings. In the preferred embodiment, the release means includes the ability to launch each vehicle independently or the ability to simultaneously launch a plurality of vehicles from the device.

In the preferred embodiment, the device further includes a vehicle energizing means capable of transmitting kinetic energy to the vehicle to energize the vehicle. Preferredly, this includes a rotation member which is contactable against one of the other wheels of the vehicle and a means for rotating the rotation member. In the preferred embodiment, a crank means is utilized to rotate the rotation member.

Further in the preferred embodiment, a track means can be associated with the device for providing a pathway the vehicle after it leaves the device. In the illustrative embodiment herein, the track means includes a first and second modular track section with a portion of a pathway on the track means being along the horizontal and a further portion of this pathway being in a direction not along the horizontal.

BRIEF DESCRIPTION OF THE DRAWINGS

The invention described in this specification will be better understood when taken in conjunction with the drawings wherein.

Figure 1:
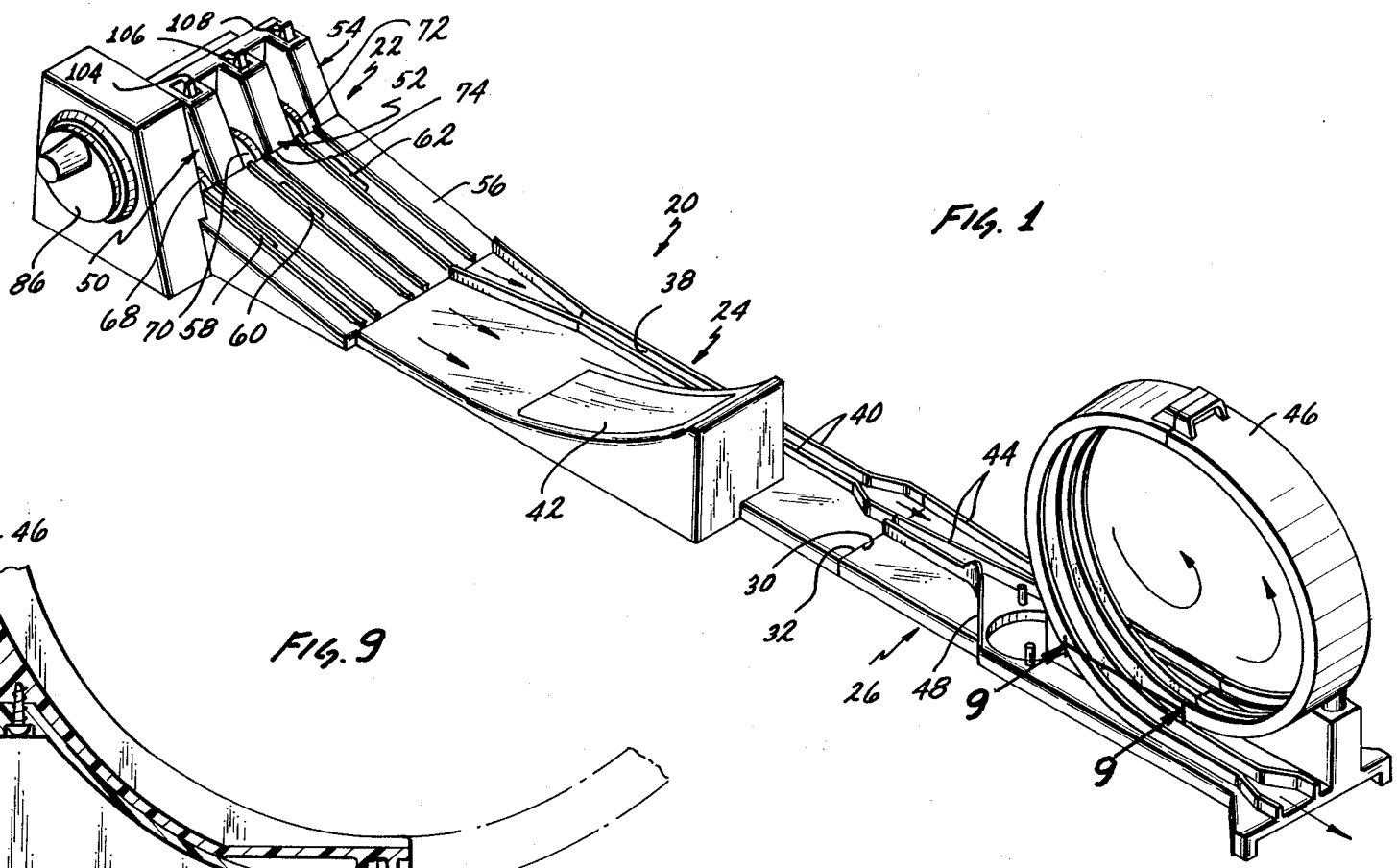
FIG. 1 is an isometric view of the invention with certain components of the invention oriented in a first spatial orientation.
Figure 9:
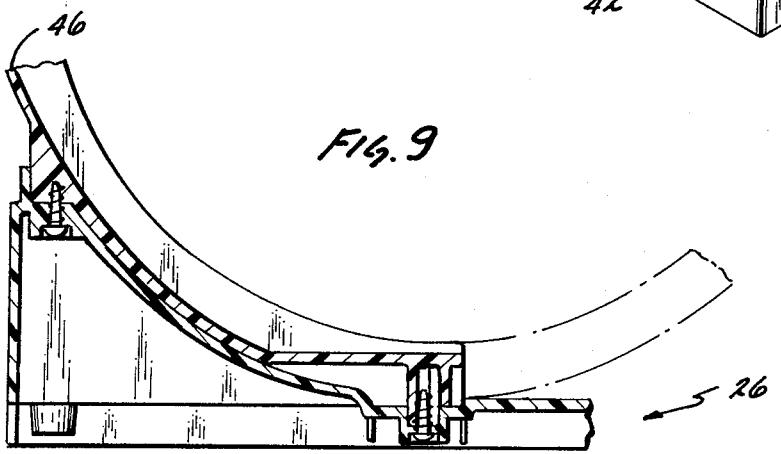
FIG. 9 is a side elevational view in section about the line 9—9 of FIG. 1.

The invention described in this specification and illustrated in the drawings utilizes certain principles and/or concepts as are set forth in the claims appended to this specification. Those skilled in the toy arts will realize that these principles and/or concepts are capable of being expressed in a variety of embodiments differing from the embodiment utilized for illustration herein. For this reason, this invention is not to be construed as being limited only to the illustrative embodiment, but is only to be construed in light of the claims.

DETAILED DESCRIPTION OF THE INVENTION

Figures 2, 8:
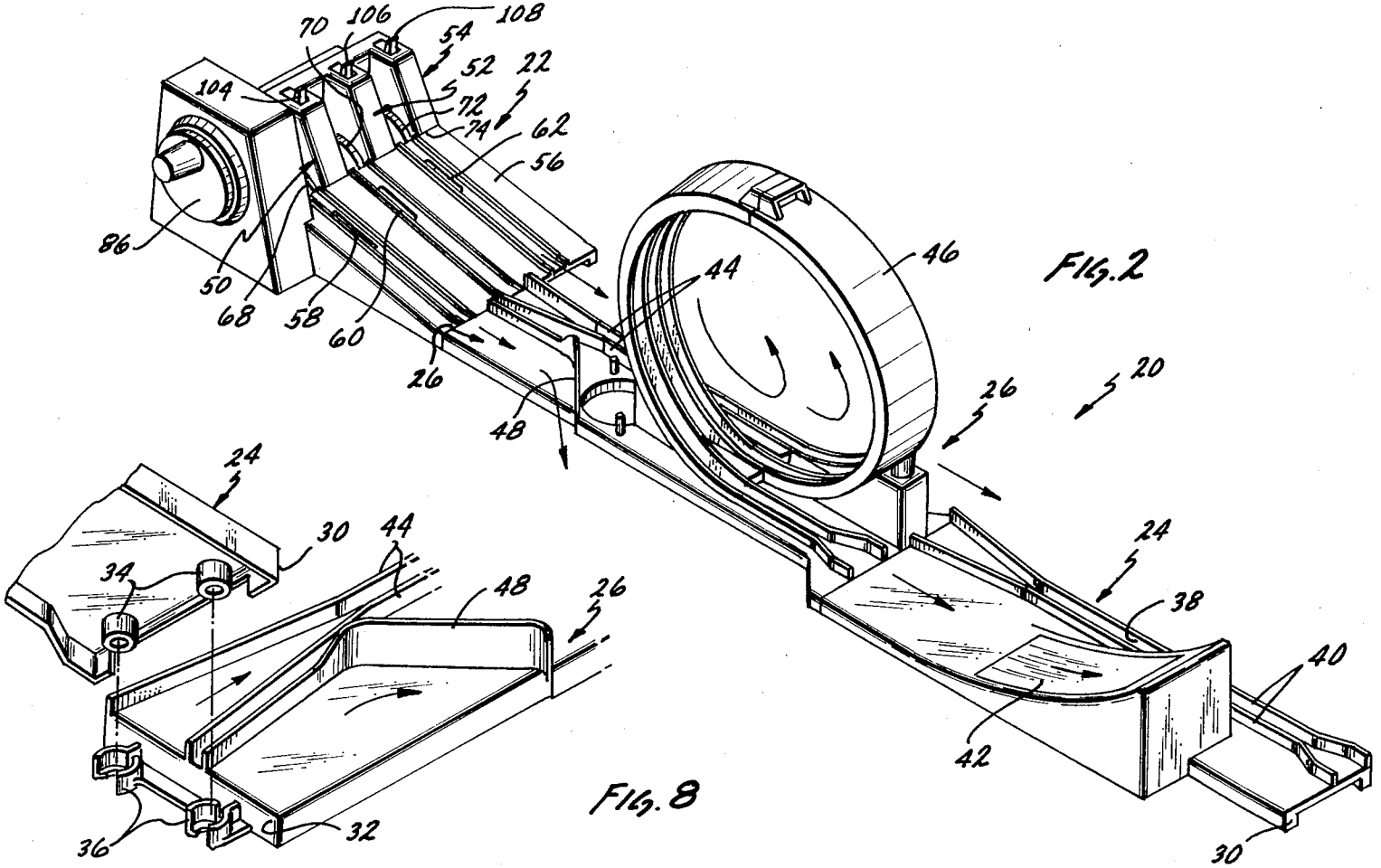
FIG. 2 is a view similar to FIG. 1 except certain of the components of the invention are oriented in a different spatial configuration.
FIG. 8 is an exploded view showing the manner of attachment of the components of FIGS. 1 and 2.

In FIGS. 1 and 2, a toy 20 incorporating the principles of this invention is shown. The toy 20 includes a launching housing 22, a first track module 24 and a second track module 26. The toy 20 is used in conjunction with a toy motorcycle 28 which preferredly is a toy known as a POP CYCLE TM, available from the Tomy Corporation, Carson, Calif.

The launch housing 22 and track modules 24 and 26 are connected together utilizing repeating units of the connectors seen in FIG. 8. In FIG. 8, as an illustration of these connectors, the underneath side of the right hand edge 30 of first track module 24 is shown exploded away from the left hand edge 32 of the second track module 26. The edge 30 of the module 24 has two downwardly projecting bosses, collectively identified by the numeral 34, located thereon. The edge 32 of the module 26 has two outwardly projecting connectors, collectively identified by the numeral 36, which receive the bosses 34. This holds the edge 30 to the edge 32. In a similar manner, the right hand edge of the launch housing 22 and the module 26 also contains similar bosses 34 and the left hand edge of the module 24 contains similar connectors 36.

The three components, 22, 24 and 26 can be arranged in two configurations, as is seen in FIGS. 1 and 2, utilizing all of the components, or one or the other of the modules 24 or 26 can be disconnected with use only of the housing 22 and the remaining module 24 or 26. Likewise, just the launching housing 22 can be utilized by itself with the toy motorcycles 28 deposited onto a support surface after leaving the launching housing 22 as hereinafter explained.

As depicted by the arrows in FIGS. 1 and 2, there are several pathways for one of the toy vehicle 28 to travel across the modules 24 and 26. The launching housing 22 is capable of launching three of the vehicles 28 simultaneously. If the modules 24 and 26 are in the configuration as seen in FIG. 1, the module on the right hand most side of the launching housing 22 as seen in FIG. 1 will be directed into pathway 38, which is formed by upstanding ribs, collectively identified by the numeral 40, located on the module 24. The other two cycles 28 which are launched from the center or the left hand most side of the launching housing 22 will go across the module 24 and then be elevated by the ramp 42 such that they jump off of the module 24. The pathway 38 continues on to the module 26 and is formed thereon by ribs, collectively identified by the numeral 44. The ribs 44 extend around a loop 46, twice, such that, one of the toy vehicles 28 traveling down the pathway 38, goes through a double loop as it crosses the module 26.

In FIG. 2, the modules 24 and 26 are rearranged. The ribs 44 on the module 26 connect to the center most station on the launching housing 22 and thus a vehicle 28 launched therefore will go down the pathway 38 through ribs 44, do a double loop around the loop 46 and then be discharged onto the module 24 towards the ramp 42. For the other two vehicles to the right and left of it, the vehicle on the far side of the module 26 will be deposited directly onto the support surface, and the vehicle on the near side of the module 26 will strike baffle 48 and then be curved toward the support surface.

Referring now to FIGS. 3 through 7, the launching housing 22 will be described in detail. The launching housing 22 has three launch stations, 50, 52 and 54. A support surface 56 leads down from each of the launch stations 50, 52 and 54. There is an opening 58, 60 and 62, respectively, at each of the launch stations. The openings 58, 60 and 62 are sized so as to accept a portion of the front wheel 64 of the vehicles 28. When the front wheels 64 of the vehicles 28 are located in one of the openings 58, 60 or 62, the rear wheel 66 of this vehicle is appropriately positioned in direct contact with a rotating wheel 68, 70 or 72 at the respective launch stations. The support surface 56 goes backward toward the rotating wheels 68, 70 and 72, but stops with its back edge 74 positioned just adjacent to, but not contacting, each of the rotating wheels 68, 70 and 72. When a vehicle 28 is appropriately located at one of the launch stations 50, 52 or 54, it is supported and held at that launch station by location of its front wheel 64 in one of the openings 58, 60 and 62, and further supported by its rear wheel 66 being located on one of the rotating wheels 68, 70 and 72.

Each of the rotating wheels 68, 70 and 72 are fixed to axle 76, which extends laterally across the inside of the launching housing 22. The axle 76 is appropriately journaled in bearing surfaces, not separately identified or numbered, in the launching housing 22.

Figure 3:
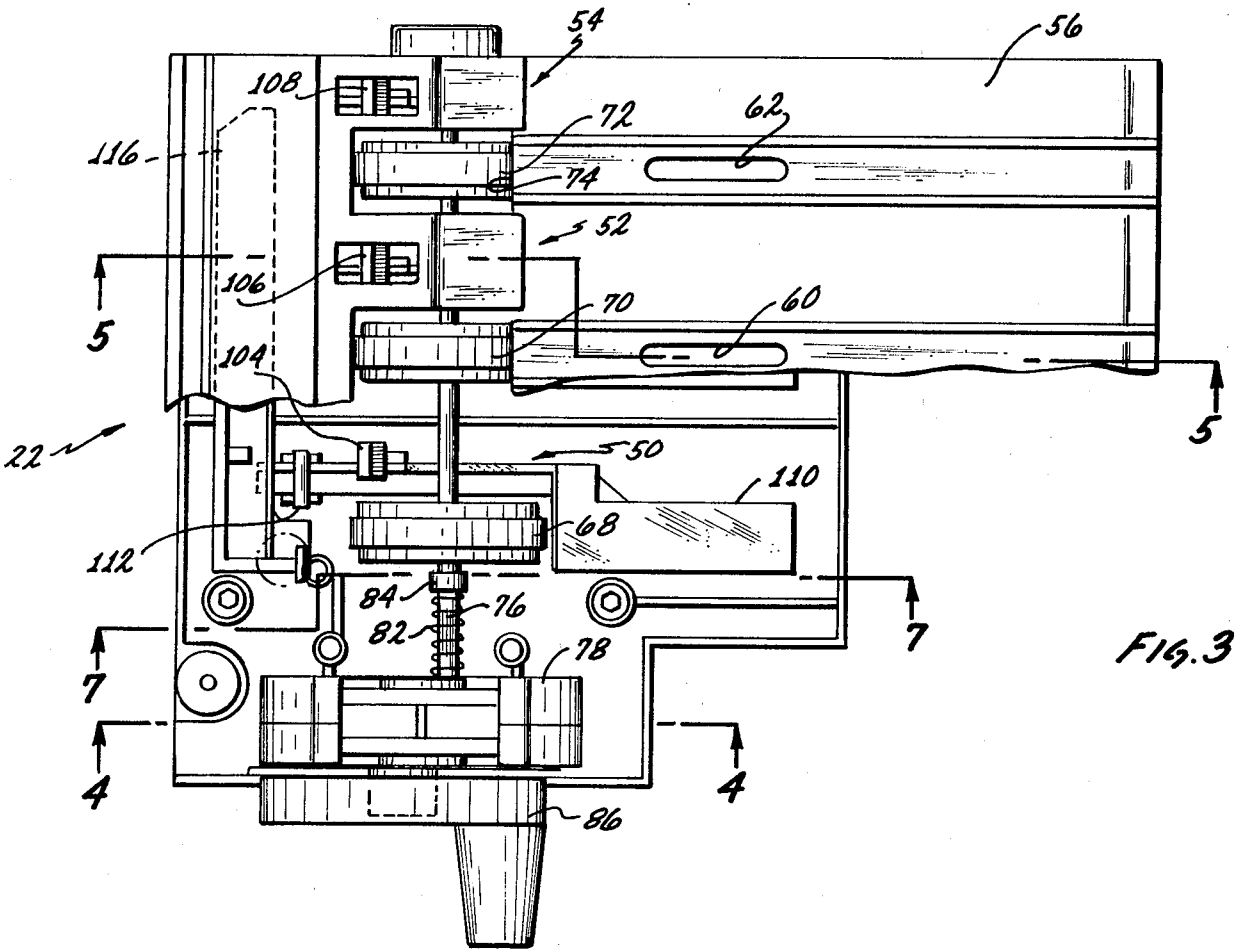
FIG. 3 is a top plan view in partial section of the left hand most component as seen in FIGS. 1 and 2.
Figure 4:
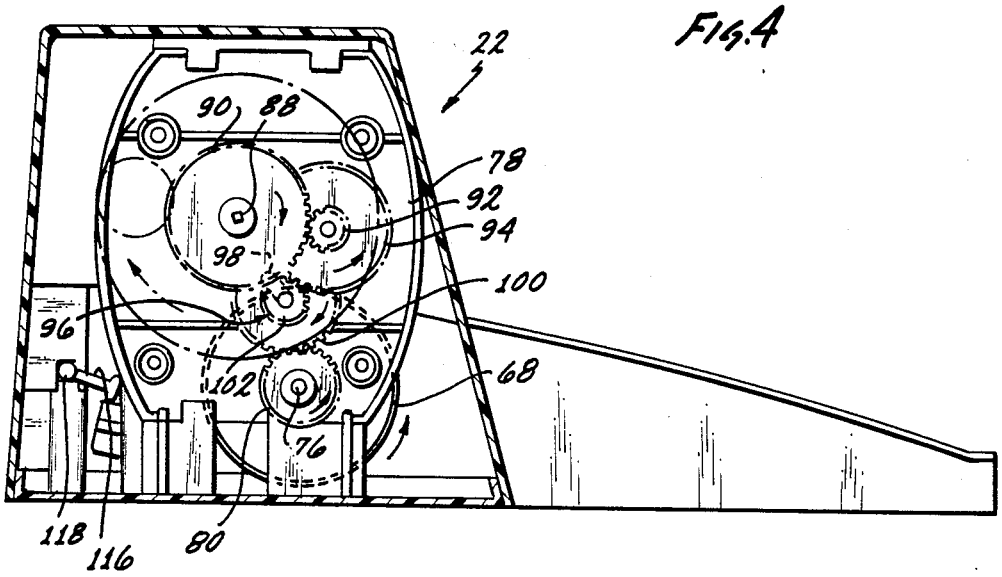
FIG. 4 is a side elevational view in section about the line 4—4 of FIG. 3.

A gear case 78, as seen in FIGS. 3 and 4, is located on one side of the launching housing 22. Inside the gear case 78, the axle 76 is attached to pinion 80. A small spring 82 pushing against a bushing 84 positions the axle 76 with respect to gear case 78 to correctly locate the rotating wheels 68, 70 and 72 in their positions within the respective launch stations 50, 52 and 54.

A crank 86 is located on the external surface of the launching housing 22. An axle 88 extends from the crank 86 into the interior of the gear case 78 and includes a spur gear 90 fixedly attached thereon. The spur gear 90 therefore turns with respect to rotation of the crank 86. The spur gear 90 meshes with a pinion 92 which is fixedly formed on a second spur gear 94. A swing gear 96 is positioned in slots 98. The swing gear 96 includes a spur gear portion 100 and a pinion portion 102. The pinion 102 is always in contact with the spur gear 94 and is rotated by it. The spur gear portion 100 will mesh with spur gear 80 if, as seen in FIG. 4, the swing gear 96 is rotating clockwise. If, however, the swing gear 96 is rotated counterclockwise, the swing gear 96 will move upwardly in the slots 98 and the spur gear 100 will disengage from the spur gear 80. As such, if the crank 86 is rotated clockwise as seen in FIG. 4, this rotation will eventually be transferred to the axle 76 and to the rotating wheels 68, 70 and 72, rotating them counterclockwise. However, if the crank 86 is rotated counterclockwise, the rotation will not be transferred to the axle 76 because there will be a break in transfer of this rotation between the spur gear 100 and the spur gear 80. Because of this, it is only possible to rotate the rotating wheels 68, 70 and 72 counterclockwise by rotation of the crank 86.

Three release levers 104, 106 and 108 are located within the launching housing 22 with one of their ends exposed out of the top surface of the launch housing 22 such that they can be acted on by the operator of the toy. The three release levers 104, 106 and 108 are located in association with the three rotating wheels 68, 70 and 72 and the three openings 58, 60 and 62, respectively. Each of the levers 104, 106 and 108 is identically constructed; therefore, only one of them need be described in detail.

Figure 7:
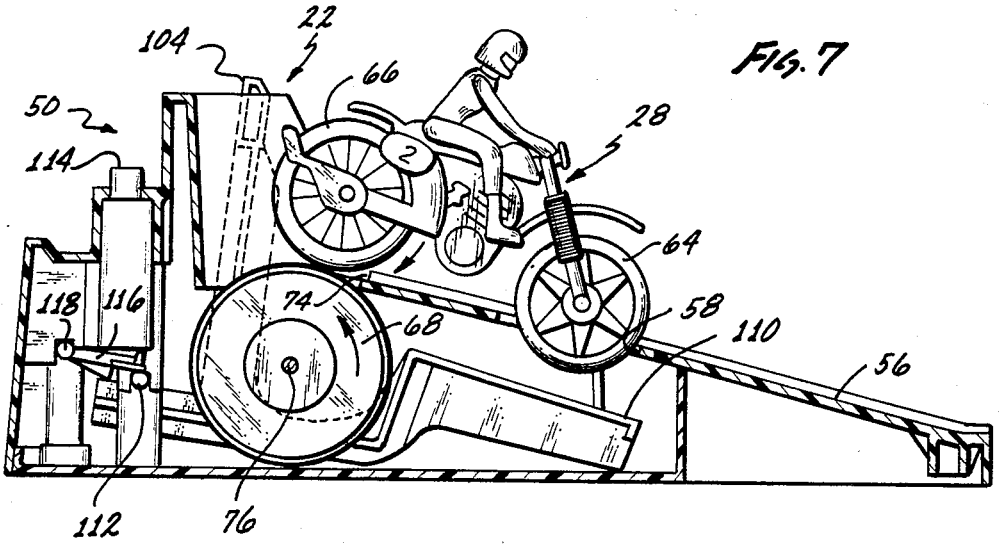
FIG. 7 is a side elevational view in partial section about the line 7—7 of FIG. 5 and is similar to FIG. 5 with respect to orientation of the wheeled vehicle thereon.

Lever 104 as seen in FIGS. 3 and 7 is a complex lever. It includes a lifting element portion 110, an axle portion 112 and an engagement portion 114. The axle portion 112 is pivotally mounted within the launching housing 22. Because the axle portion 112 is on the far side of the center of mass of the release lever 104, the weight of the lifting element portion 110 biases it downward such that it is normally in the position as seen in FIG. 7 through the influence of gravity. The lifting element portion 110 is located below the opening 58 and is capable of interacting with the front wheel 64 of the vehicle 28 if the release lever 104 is rotated counterclockwise as seen in FIG. 7.

Figure 5:
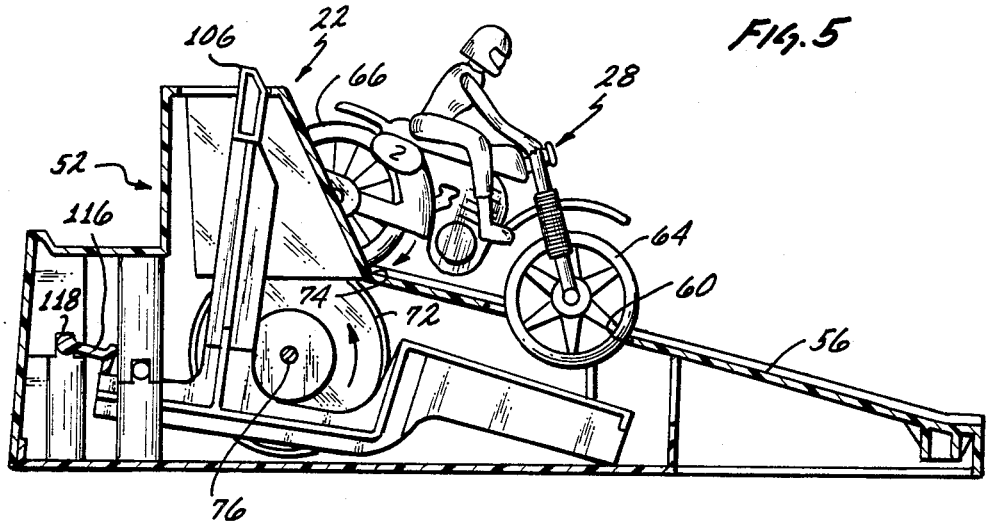
FIG. 5 is a side elevational view in partial section about the line 5—5 of FIG. 3 with a wheeled toy vehicle located on this component in a first position.
Figure 6:
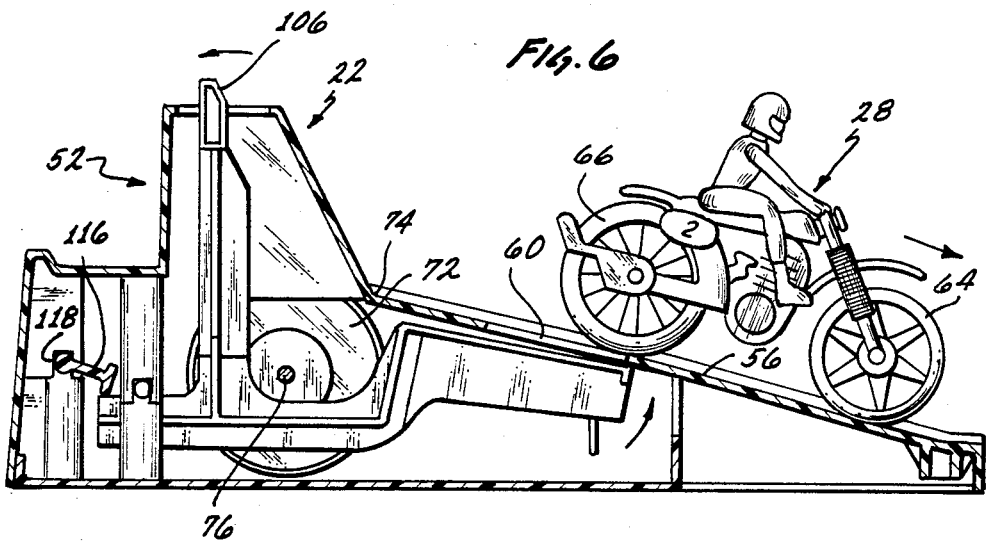
FIG. 6 is a view similar to FIG. 5 except that the wheeled vehicle has moved to a different position.

Referring now to FIGS. 5 and 6, launching of the vehicle 28 will be described. The vehicle 28 is placed on the launching housing 22 with its front wheel 64 located in the opening 60. This places the rear wheel 66 of the vehicle 28 in contact with rotating wheel 70. Upon rotation of the crank 86 clockwise, the rotating wheel 70 is driven counterclockwise, which, because it is in contact with the rear wheel 66, rotates the rear wheel 66 clockwise. When sufficient momentum has been transferred to the rear wheel 66, the operator of the toy 20 ceases rotating the crank 86 and is now ready to launch the vehicle 28.

By pulling back on the release lever 106, the lifting element portion 110 of the release lever 106 is lifted upwardly, as can be seen in moving from FIG. 5 to FIG. 6. This lifts the front wheel 64 out of the opening 70. Prior to lifting the front wheel 64 out of the opening 70, forward motion of the vehicle 28 was prohibited by the interaction of the front wheel 64 with the opening 70. Once the front wheel 64 is lifted out of the opening 70, the vehicle 28 is propelled forward down the support surface 56 initially by the rear wheel 66 moving incrementally against the rotating wheel 70 and then contacting the edge 74 of the support surface 56 and finally the totality of the support surface 56. The flywheel effect of the rear wheel 66 of the vehicle 28 drives the vehicle 28 forward off of the support surface 56 and on to some other surface, or on to one of the first or second track modules 24 or 26. In this manner, the vehicles 28 located at the individual launch stations 50, 52 or 54 can be individually launched via the release levers 104, 106 and 108.

If it is desirable to concurrently launch two or three vehicles, instead of launching them individually by the release levers 104, 106 and 108, they can be launched concurrently by utilizing the gang release button 114.

An elongated plate 116 serves as a gang release member. The plate 116 is hinged about its back edge via an elongated round rib 118 formed thereon. The rib 118 is appropriately located in bearing surfaces in the launching housing 22. The gang plate 116 rests on the back edge of the axle portion 112 of the release levers 104, 106 and 108. The gang release button 114 extends downwardly in an appropriate hollow housing and rests on top of the gang plate 116. When the gang release button 114 is pressed downwardly, it presses the gang release plate 116 downwardly onto all of the release levers 104, 106 and 108 simultaneously to concurrently lift their lifting element portions 110 upwardly toward their respective openings 58, 60 and 62 to simultaneously launch any vehicles 28 located at the launch stations 50, 52 and 54.

Because of the bias of gravity acting on the lifting element portion 110 of each of the release levers 104, 106 and 108, normally the release levers 104, 106 and 108 are resting in the position shown in FIG. 5 or 7. These release levers are only moved to the position shown in FIG. 6 for the release lever 106 if either the individual release levers 104, 106 or 108 are moved or if the gang release button 114 is depressed.

I claim:

1. A device for use in association with wheeled toy vehicles having front and rear wheels which comprises:

a support structure;

a vehicle support surface located on said support structure, said support surface including an opening, said opening sized and shaped so as to allow a front wheel of a wheeled toy vehicle to be at least partially located within said opening;

vehicle energizing means located on said support structure said vehicle energizing means including a rotating wheel, a crank, and a clutch means;

said crank capable of being rotated by the operator of said toy, said clutch means operatively connecting said rotating wheel to said crank, said clutch means for transferring to said rotating wheel rotation of said crank in a first direction, and inhibiting transfer to said rotating wheel rotation of said crank in the opposite direction such that said rotating wheel is rotated in only one direction by said crank;

said rotating wheel and said opening in said support surface positioned on said support structure in association with one another whereby when said front wheel of said vehicle is located in said opening in said support surface, the rear wheel of said vehicle is positioned on and is supported by said rotating wheel so as to be rotated by said rotating wheel in response to rotation of said rotating wheel by said crank;

an element movably located on said support structure in association with said opening, said element movable toward and away from said opening;

release means located on said support structure in association with said element, said release means for moving said element toward said opening, said release means moving said element toward said opening such that said element contacts said front wheel located in said opening and displaces said front wheel from said opening as said element moves toward said opening.

2. The device of claim 1 wherein:

said surface includes a plurality of said openings, each of said plurality of said openings sized and shaped so as to allow a front wheel of a wheeled toy vehicle to be at least partially located in said opening, said openings located in an array in said support surface so as to allow a plurality of said vehicles equal in number to said plurality of openings to be located on said support surface with one of the front wheels of each of said plurality of vehicles located in one of said openings;

a plurality of said rotating wheels each operatively connected by said clutch means to said crank so as to be rotated by said crank;

each of said openings positioned in association with one of said rotating wheels whereby when a front wheel of a vehicle is located in one of said openings, the rear wheel of said vehicle is positioned on and is supported by the respective rotating wheel so as to be rotated by the respective rotating wheel associated with the respective openings;

further including a plurality of said elements equal in number to said plurality of said openings, each of said elements movably associated with one of said openings so as to move towards and away from said opening with which it is associated;

release means associated with each of said elements for moving said elements toward their respective associated openings.

3. The device of claim 2 wherein:

said release means includes a plurality of single release means equal in number to said plurality of said elements, each of said single release means located on said housing in association with one of said elements and capable of moving said one of said elements with which it is associated towards its respective opening.

4. The device of claim 2 wherein:

said release means includes a gang release means located on said housing in association with all of said plurality of elements, said gang release means for moving in unison each of said elements towards its respective opening.

5. The device of claim 3 wherein:

said release means further includes a gang of release means located on said housing in association with said all of said plurality of elements, said gang release means for moving in unison each of said elements towards its respective opening.

6. The device of claim 1 wherein:

said element is positioned below said opening and is biased by gravity away from said opening.

7. The device of claim 2 wherein:

said elements are positioned below their respective openings and are individually biased by gravity away from said openings.

8. The device of claim 5 wherein:

said elements are positioned below their respective openings and are individually biased by gravity away from said openings.

9. The device of claim 2 wherein:

said release means includes a plurality of single release means equal in number to said plurality of said elements, each of said single release means located on said housing in association with one of said elements and capable of moving said one of said elements with which it is associated towards its respective opening.

10. The device of claim 2 wherein:

said release means includes a gang release means located on said housing in association with all of said plurality of elements, said gang release means for moving in unison each of said elements towards its respective opening.

11. The device of claim 9 wherein:

said release means further includes a gang release means located on said housing in association with said all of said plurality of elements, said gang release means for moving in unison each of said elements towards its respective opening.

12. The device of claim 1 including:

track means connectable to said support structure, said track means for forming a defined vehicular pathway for said wheeled toy vehicle to travel after said front wheel of said wheeled toy vehicle has been displaced from said opening by said element.

13. The device of claim 12 wherein:

said track means includes at least a first and a second modular track section, each of said track sections including a portion of a vehicular pathway located thereon;

further including connecting means, said connecting means located on said first track section, said second track section and said support structure, said connecting means for connecting said first and said second track sections and said support structure into a temporarily unified body.

14. The device of claim 5 including:

track means connectable to said support structure, said track means for forming a defined vehicular pathway for said wheeled toy vehicle to travel after said one of said wheels of said wheeled toy vehicle has been displaced from said opening by said element;

said track means includes at least a first and a second modular track section, each of said track sections including a portion of a vehicular pathway located thereon;

further including connecting means, said connecting means located on said first track section, said second track section and said support structure, said connecting means for connecting said first and said second track sections and said support structure into a temporarily unified body.

15. The device of claim 12 including:

track means connectable to said support structure, said track means for forming a defined vehicular pathway for said wheeled toy vehicle to travel after said one of said wheels of said wheeled toy vehicle has been displaced from said opening by said element;

said track means includes at least a first and a second modular track section, each of said track sections including a portion of a vehicular pathway located thereon;

further including connecting means, said connecting means located on said first track section, said second track section and said support structure, said connecting means for connecting said first and said second track sections and said support structure into a temporarily unified body.

16. The device of claim 15 wherein:

at least one of said first and said second modular track sections includes a horizontally oriented portion of said pathway and at least one of said first and said second modular track sections includes a non-horizontally oriented portion of said pathway.

* * * * *